US007287622B2

(12) United States Patent
Rauch et al.

(10) Patent No.: US 7,287,622 B2
(45) Date of Patent: Oct. 30, 2007

(54) EXHAUST MUFFLER

(75) Inventors: Robert J. Rauch, Thief River Falls, MN (US); Ole E. Tweet, Thief River Falls, MN (US)

(73) Assignee: Arctic Cat Inc., Thief River Falls, MN (US)

( * ) Notice: Subject to any disclaimer, the term of this patent is extended or adjusted under 35 U.S.C. 154(b) by 211 days.

(21) Appl. No.: 11/019,154

(22) Filed: Dec. 20, 2004

(65) Prior Publication Data

US 2006/0131102 A1 Jun. 22, 2006

(51) Int. Cl.
*F01N 3/022* (2006.01)
*F01N 3/06* (2006.01)
*F01N 1/02* (2006.01)

(52) U.S. Cl. ..... 181/272; 181/231; 181/249; 181/251; 181/255; 181/257; 181/268; 181/269; 181/275

(58) Field of Classification Search ..... 181/231, 181/249, 251, 255, 257, 268, 269, 272, 275
See application file for complete search history.

(56) References Cited

U.S. PATENT DOCUMENTS 4,124,091 A * 11/1978 Mizusawa ..... 181/231
4,164,266 A * 8/1979 Collin et al. ..... 181/250
4,393,956 A * 7/1983 Tsukui et al. ..... 181/265
4,911,262 A * 3/1990 Tani et al. ..... 181/266
5,969,299 A * 10/1999 Yamaguchi et al. ..... 181/227
6,189,650 B1 * 2/2001 Inuzuka et al. ..... 181/254
6,250,422 B1 6/2001 Goplen et al.
6,540,046 B1 4/2003 Schuhmacher et al.
6,571,911 B2 * 6/2003 Watanabe et al. ..... 181/265
6,640,927 B1 11/2003 Turner
6,722,124 B2 4/2004 Pawson et al.
2004/0089500 A1 * 5/2004 Lewis ..... 181/249
2004/0182643 A1 * 9/2004 Toyoshima ..... 181/272
2004/0238272 A1 * 12/2004 Wan et al. ..... 181/251

* cited by examiner

*Primary Examiner*—Lincoln Donovan
*Assistant Examiner*—Jeremy Luks
(74) *Attorney, Agent, or Firm*—Black Lowe & Graham, PLLC

(57) ABSTRACT

The present specification discloses a muffler for attenuating exhaust noise from an internal combustion engine. The muffler includes a main chamber, an intermediate pipe, a diffuser chamber, a spark arrester, and an exhaust pipe. Exhaust gases from the engine enter the main chamber after which they flow through the intermediate pipe. The intermediate pipe extends back through the main chamber to the diffuser chamber. The spark arrester is a screen held within the exhaust muffler and removably coupled to the exhaust pipe. Gases flow through the screen to separate hot particles. The exhaust pipe extends within the main chamber, completing a 180° bend within the chamber before exiting the main chamber and the muffler. An outer enclosure may surround the muffler. A method of attenuating exhaust gas noise is also disclosed.

12 Claims, 13 Drawing Sheets

EXHAUST MUFFLER

FIELD OF THE INVENTION

This invention relates generally to exhaust mufflers for internal combustion engines and, more specifically, to a compact exhaust muffler for small vehicles.

BACKGROUND OF THE INVENTION

Mufflers with spark arresters attenuate exhaust gas noise and sparks from internal combustion engines. However, mufflers add size, weight, and power-robbing backpressure to an engine. Small vehicles, such as all terrain vehicles (ATVs), motorcycles, and snowmobiles, need high power-to-weight ratios for optimum performance. Small size and low weight help the driver maneuver the vehicle through off-road obstacles. A high power-to-weight ratio helps the vehicle climb and accelerate, and increases available load-carrying capacity. While an effective muffler adds weight and reduces horsepower, quiet operation without exhaust spark emissions not only enables the vehicle to meet mandatory government regulations, but increases the vehicle acceptance by both the user and others wishing to enjoy the outdoor environment.

Typical commercially available mufflers reduce noise levels to regulation standards. However, the noise level may still not be acceptable to users and others in the vicinity. Manufacturers may be reluctant use mufflers that decrease the noise level much below government mandates since such reductions usually result in an increase in muffler weight, size, and/or backpressure. Muffler noise reductions may be increased with additional baffles and chambers or by increasing size—the very changes that also increase weight and backpressure. Such changes also increase the complexity and cost of manufacture.

Backpressure occurs when exhaust gases do not have a direct, easy-flow exit route. The engine must push the gases out through a tortuous (although noise-canceling) path of chambers, baffles, tubes, and turns. Thus backpressure restricts power that would have been available to propel the vehicle.

Therefore, a need exists for a muffler that decreases backpressure without increasing noise, or conversely, that decreases noise without increasing backpressure. Further advantages would result with simplified manufacturing and lighter weights.

SUMMARY OF THE INVENTION

The present invention provides a muffler for a small vehicle of a size that fits within the envelope of the current systems. The muffler reduces noise, weight, and complexity. It also decreases exhaust gas backpressure.

The present invention provides a muffler for attenuating exhaust gas noise from an internal combustion engine. The muffler includes a main chamber and an exhaust pipe. Exhaust gases are channeled into the main chamber from the engine. The main chamber, in the preferred embodiment, encloses at least a third of the volume of the muffler. The exhaust pipe is in fluid communication with the main chamber. The exhaust pipe extends through the main chamber and receives exhaust gases from the main chamber (preferably via a diffusion chamber).

In one aspect of the invention, an intermediate pipe is provided. The intermediate pipe is in fluid communication with the main chamber (preferably via a transition chamber) at its first end and with the exhaust pipe at its second end. The intermediate pipe extends through the main chamber.

In a further aspect of the invention, the exhaust pipe includes a bend in a mid portion thereof as it extends within the main chamber. Preferably, the bend substantially completes a 180° turn within the main chamber. With such bend, the exhaust pipe is longer than the main chamber.

In still a further aspect of the invention, a diffusion chamber is situated adjacent the main chamber. Gases enter the diffusion chamber after leaving the main chamber and before entering the exhaust pipe. The diffusion chamber may be smaller than the main chamber.

The preferred embodiment of the invention also includes a spark arrester disposed within the diffusion chamber and connected to the exhaust pipe. Gases pass through the spark arrester before entering the exhaust pipe. In one aspect of the invention, the spark arrester is removable from the outside of the muffler.

The present invention may also be defined as a muffler for an internal combustion engine including a chamber, a first pipe portion, a second pipe portion, and a muffler exit. Exhaust gases are channeled into the chamber from the engine. The chamber includes a chamber exit. The first pipe portion is in fluid communication with the chamber exit. The first pipe portion extends through at least half of the length of the chamber. The second pipe portion is also in fluid communication with the first pipe portion. The second pipe portion also extends through at least half of the length of the chamber. The muffler exit is in fluid communication in the second pipe portion. Exhaust gases are channeled from the chamber through the first pipe portion to an opposite end of the chamber and then through the second pipe portion and out of the muffler.

The present invention further includes a method of attenuating exhaust noise of an internal combustion engine. The method includes channeling exhaust gases from the engine into the main chamber. The gases are then channeled from the main chamber into an exhaust pipe that extends through the main chamber. The exhaust pipe is longer than the length of the main chamber, as the pipe includes a bend within the main chamber. Finally, the gases are channeled from the pipe to an exhaust exit.

In the preferred method of the invention, the gases are channeled through an intermediate pipe between the main chamber and the exhaust pipe. The gases are also channeled through a transition aperture to a diffusion chamber between the intermediate pipe and the exhaust pipe. Thus, the gases flow from the engine to the main chamber out of the main chamber exit (e.g., through the transition aperture and transition chamber), through the intermediate pipe into the diffuser, through a spark arrester disposed between the main chamber and the exhaust pipe in the diffuser, and through the exhaust pipe including surrounding the bend within the exhaust pipe to exit the external portion of the muffler.

In still a further aspect of the invention, an apparatus for exhaust noise attenuation is provided. The apparatus includes a muffler and an outer enclosure. The muffler has an exhaust entrance port, a first chamber, and an exhaust exit port. The outer enclosure is spaced from and at least substantially encloses a majority of the muffler. The muffler exhaust port dumps exhaust into the outer enclosure. The outer enclosure further includes an enclosure exit port.

The further aspect of this embodiment of the invention, the muffler includes at least two walls. The outer enclosure is separated from the two walls. The outer enclosure forms a chamber between the two walls and the outer enclosure.

Preferably, the enclosure exit port is disposed through a wall of the enclosure removed from the exhaust exit pipe port.

The muffler with the spark arrester arrangement may also be defined as including an exhaust entrance port, a diffuser chamber, a diffuser chamber exit port, and a spark arrester. The diffuser chamber is in fluid communication with the entrance port. The spark arrester is at least partially disposed within the diffuser chamber. It is coupled to the diffuser chamber exit port. The spark arrester includes a screen through which exhaust gases pass to flow through the diffuser chamber exit port. The screen is removably coupled to the diffuser chamber such that it can be removed from the muffler.

Further aspects of the spark arrester included with the muffler include accessibility from outside of the muffler. The spark arrester forms a tube shape having two ends. One end of the spark arrester engages the diffuser chamber exit port. The other end has a cap thereon. The end with the cap is adjacent the diffuser chamber sidewall. The cap engages the end of the diffuser chamber and end of the muffler.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

Figure 1:
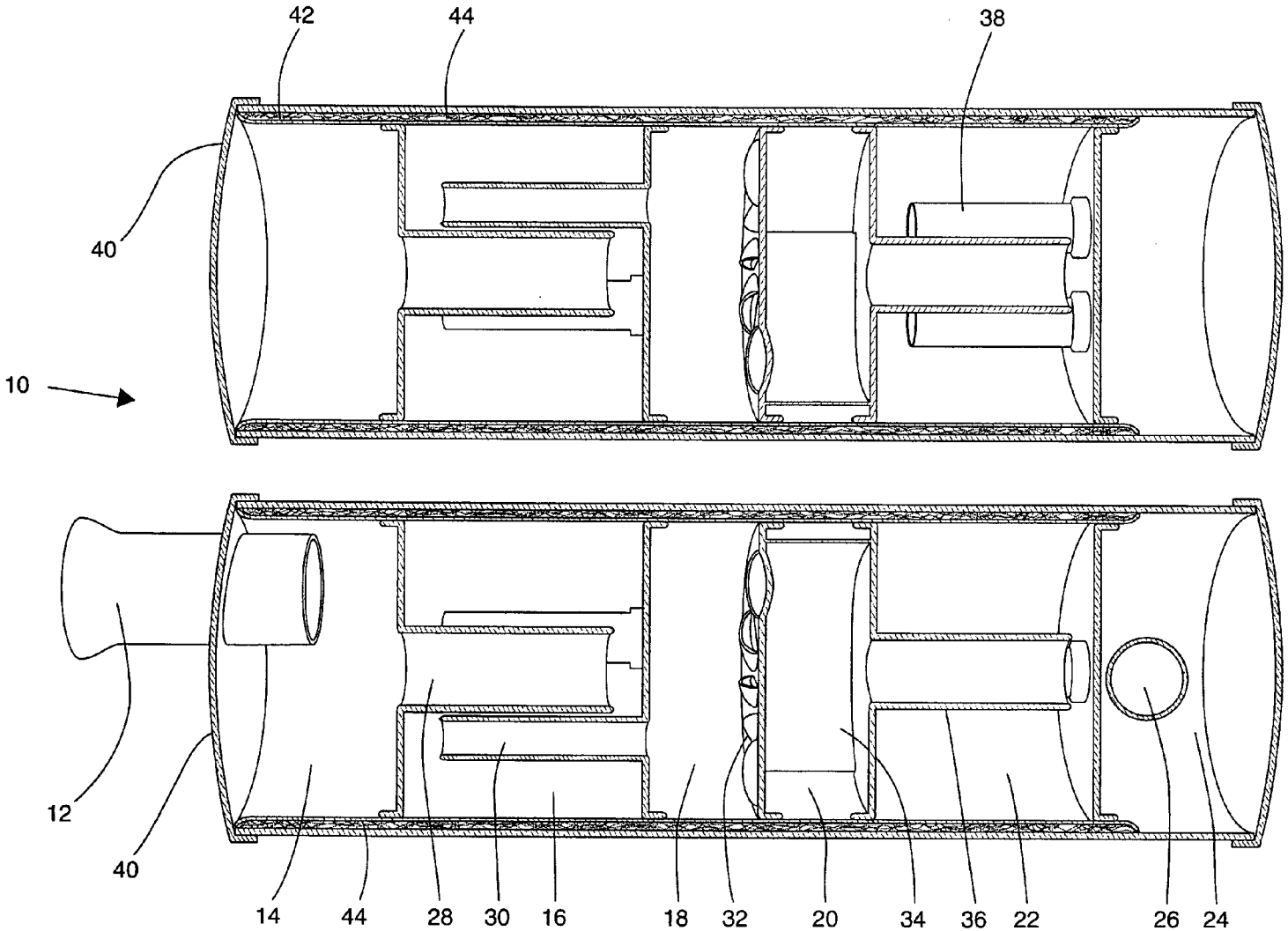
FIG. 1 is a cross-sectional view of two halves of a prior-art muffler illustrating the various chambers.
Figure 2:
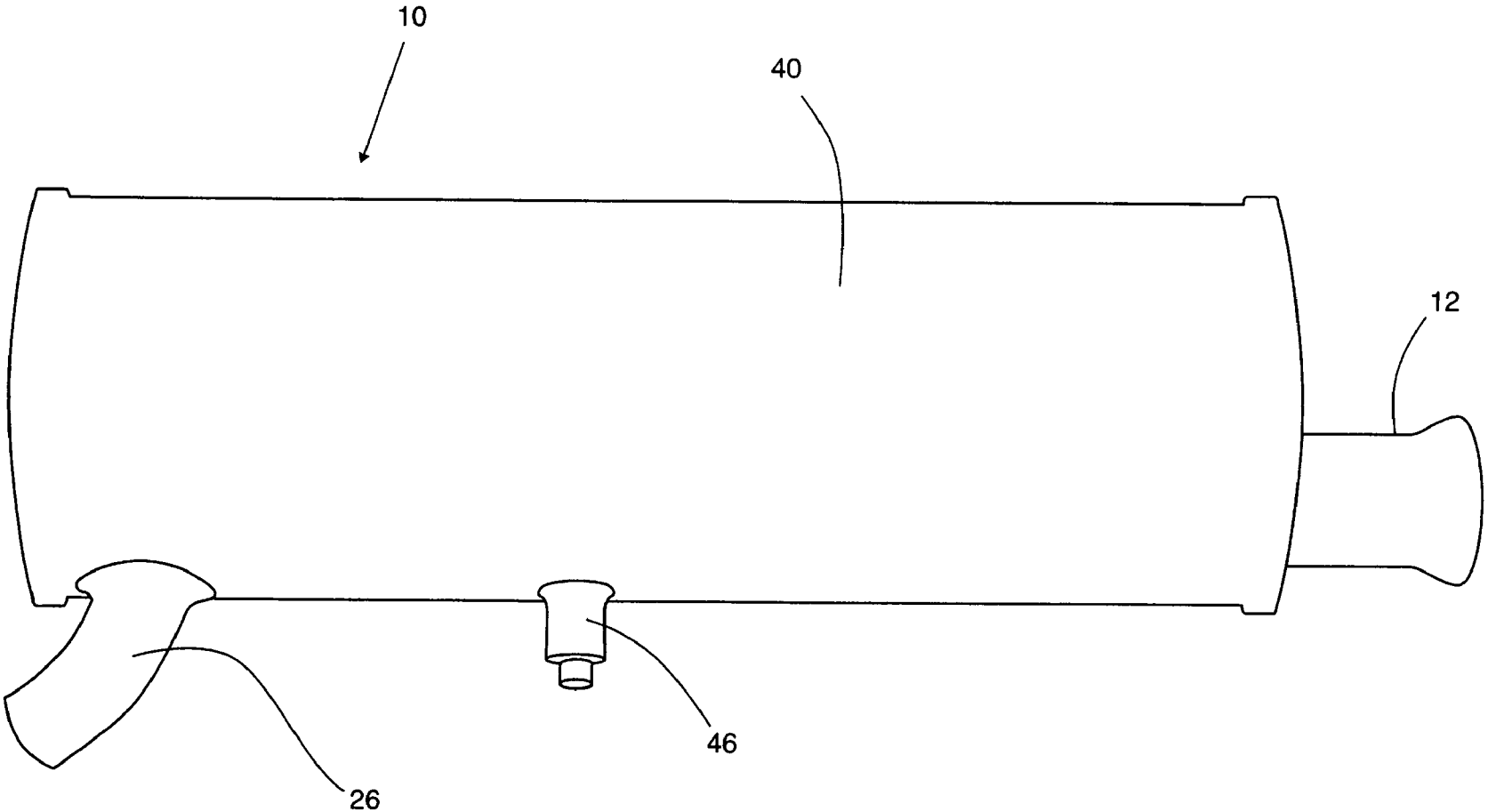
FIG. 2 is a side elevational view of the prior-art muffler shown in FIG. 1.

An understanding of a typical prior-art muffler helps develop an appreciation for the present invention. A standard muffler 10 such as that used with ATVs is illustrated in FIGS. 1 and 2. Muffler 10 has a generally cylindrical shape with an inlet pipe 12 and an outlet pipe 26 at opposing ends thereof. Various chambers are situated between inlet pipe 12 and outlet pipe 26. In the illustrated example, six chambers are included. Inlet pipe 12 extends through an outer shell 40 to direct exhaust gases from the engine into first chamber 14. First chamber 14 is generally cylindrical in shape and is bounded by an inner shell 42, which is secured to outer shell 40, as well as the first end of outer shell 40 and a wall between first chamber 14 and second chamber 16. The diameter of first chamber 14 is about twice its length. First chamber 14 creates a small expansion chamber for hot gases from inlet pipe 12. These gases are then directed through second chamber inlet pipe 28 into second chamber 16.

Second chamber 16 is also cylindrical in shape, but has a length approximately equal to its diameter. Furthermore, second chamber 16 includes second chamber inlet pipe 28 and second chamber outlet pipes 30 therein. These pipes extend nearly the entire length of the chamber. Exhaust gases enter second chamber inlet pipe 28, pass through the pipe and into second chamber 16 at the far end thereof. The gases then circle back to the front end of the chamber to enter into the three second chamber outlet pipes 30. These pipes are smaller in diameter than inlet pipe 28. However, three pipes are included to channel the gases out of second chamber 16 and into third chamber 18.

Third chamber 18 is much smaller than second chamber 16. Third chamber 18 is bounded on its downstream end by a diffuser wall 32. Diffuser wall 32 includes diffusion openings to circulate the air into fourth chamber 20.

Fourth chamber 20 is approximately the same size as third chamber 18, but includes a separation wall 34 to separate any sparks from the remaining exhaust gases. The debris (e.g., carbon deposits) is collected beneath the separator wall 34 and may be removed from muffler 10 with soot plug 46 as illustrated in FIG. 2. Exhaust gases leave fourth chamber 20 through fifth chamber inlet pipe 36.

Fifth chamber inlet pipe 36 directs gases into fifth chamber 22 in a manner similar to second chamber inlet pipe 28 with regard to second chamber 16. Likewise, fifth chamber 22 also includes fifth chamber outlet pipes 38 that channel the exhaust gases through another wall and into sixth chamber 24. One inlet pipe 36 is utilized and three fifth-chamber outlet pipes 38 are provided.

Sixth chamber 24 is used to collect the exhaust gases for channeling them to outlet pipe 26.

Note that an inner shell 42 is secured to outer shell 40 with spacing between the two shells. An absorption layer 44 is placed within the spacing for noise attenuation. Absorption layer 44 may include standard glass packing materials.

The prior-art muffler accomplishes the goals of reducing noise levels to within legal limits and provides a spark arrester feature with a soot cleaning plug 46. The muffler is also of a size that allows it to fit within the space required on the back of a small vehicle such as an all-terrain vehicle (ATV). However, further reductions in noise levels may be preferable for users and others in the vicinity of the user of the vehicle. Furthermore, the muffler introduces excessive back pressure such that the horsepower of the engine is adversely affected. Opening up the muffler to decrease the back pressure may be accomplished, but not without noise increases.

Furthermore, in situations where certain amount of back pressure is desired for optimum engine performance, the prior-art mufflers require that different designs be created and produced to tune the muffler for each engine application. This is the case, for example, with a family of ATVs of differing engines and engine sizes. Back pressure requirements would differ in each case. Thus, a different muffler must be designed and manufactured for each ATV. This will increase the cost of manufacture of the mufflers since each will necessarily be produced in lower quantities. This may not be an issue in many instances since the back pressure introduced by the muffler in order to create sufficient noise reduction is such that it exceeds the back pressure needed for optimum engine performance. In such instance, engine performance (horsepower) suffers, as explained above.

The present invention provides a muffler that has low back pressure with a device for changing the back pressure dependent upon the engine requirements for optimum horsepower. The system is also lighter weight and cheaper to manufacture than prior-art mufflers. This muffler and its various components are illustrated in FIGS. 3-6.

Figure 3:
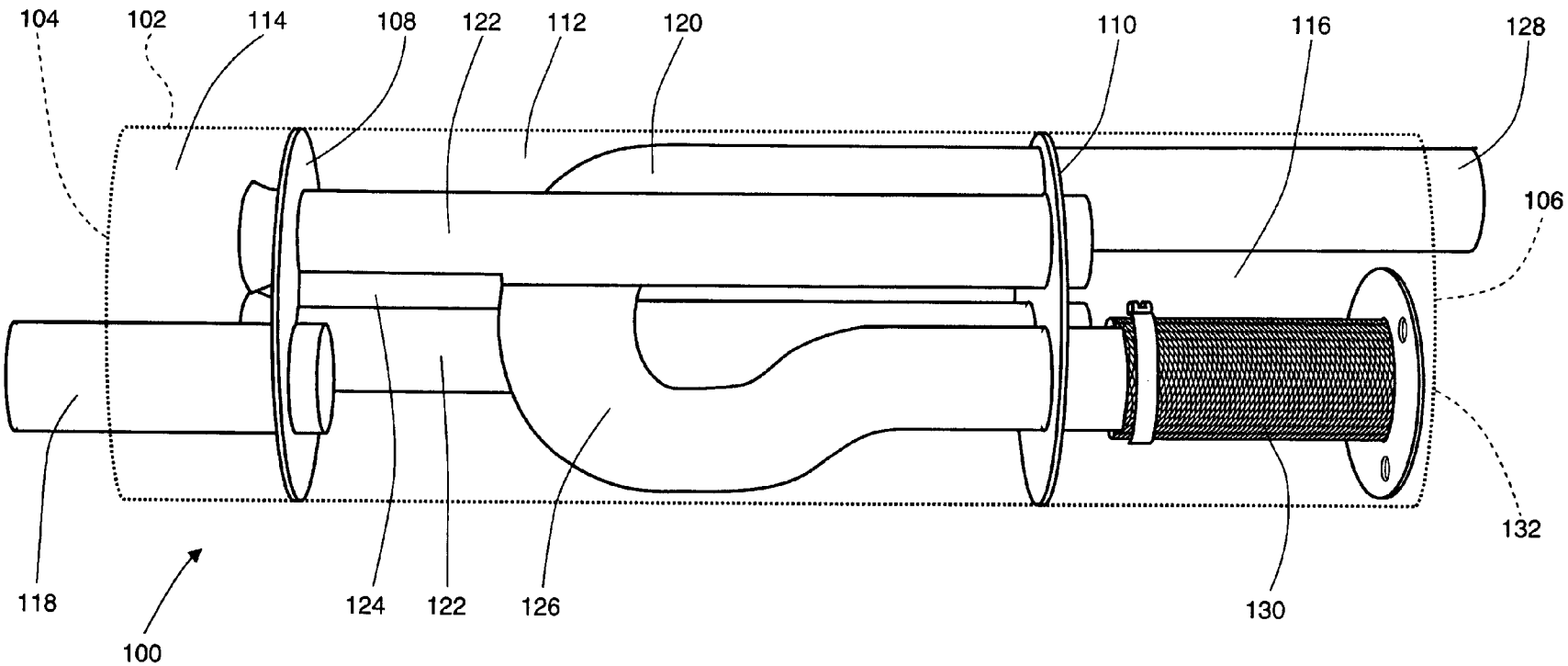
FIG. 3 is a perspective view of a muffler of the present invention showing the outer shell in phantom.

Referring first to FIG. 3, the internal construction of muffler 100 is illustrated. Muffler 100 includes an outer shell 102 (shown in phantom in FIG. 3). Outer shell 102 includes a first end wall 104 at the upstream end of muffler 100 and a second end wall 106 at the downstream end. First and second inner walls 108 and 110 lying in plains parallel to end walls 104 and 106 are also provided within outer shell 102.

End walls 104 and 106 along with inner walls 108 and 110 divide muffler 100 into three chambers: a main chamber 112, a transition chamber 114, and a diffusion chamber 116. Main chamber 112 is the largest of the chambers and preferably comprises one-third to one-half or more of the total volume of muffler 100. Transition chamber 114 is at one end of the muffler being bounded by first end wall 104 and first inner wall 108. Diffusion chamber 116 is at the opposite end of muffler 100 being bounded by second inner wall 110 and second end wall 106. Alternatively, any type of diffuser may be employed, whether a diffusion chamber, a diffuser wall, or other device. In the preferred embodiment a diffusion chamber is used as illustrated and described herein.

Figure 4:
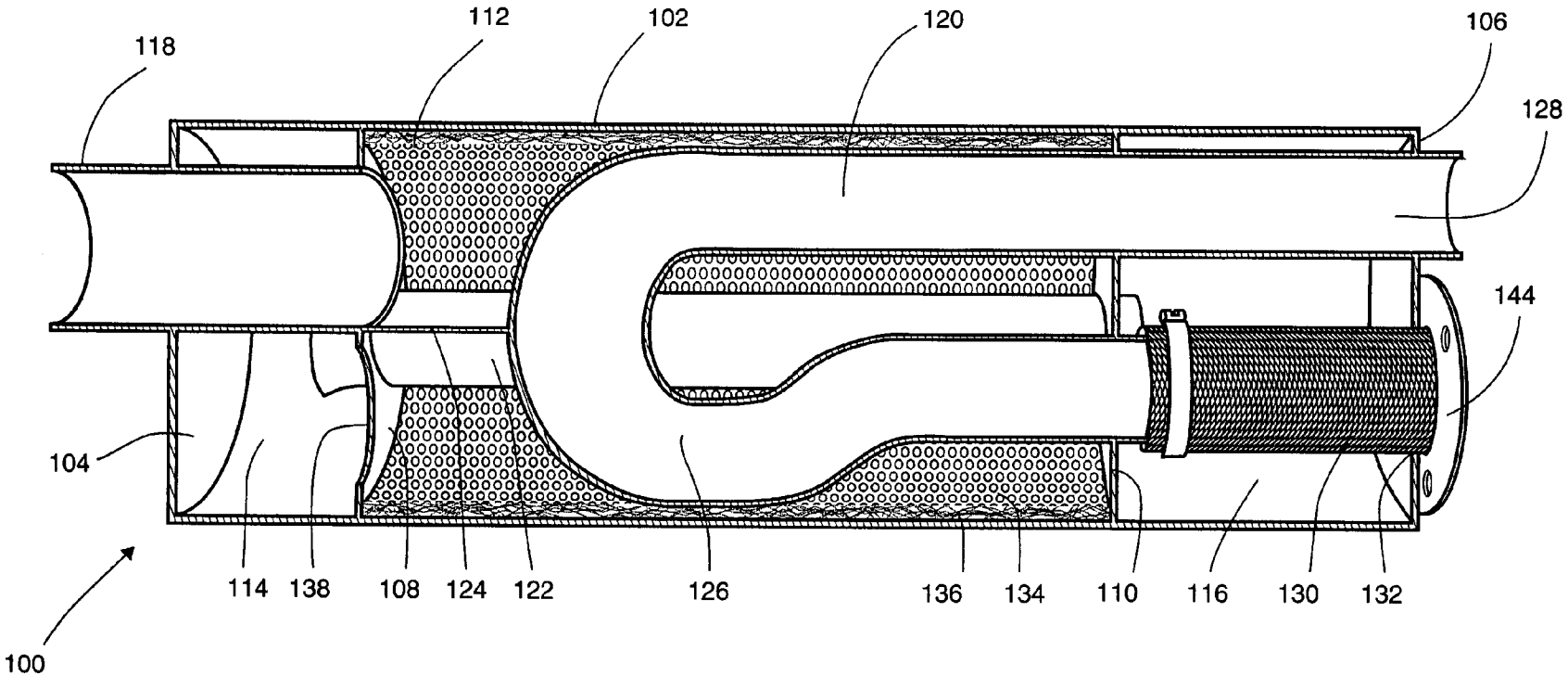
FIG. 4 is a cross-sectional view of the muffler.

As can be seen in FIGS. 3 and 4, numerous pipes are situated within muffler 100. An inlet pipe 118 is extends through first end wall 104 and first inner wall 108 to channel exhaust gases from the pipe leading from the engine of the vehicle into main chamber 112. At the opposite end of muffler 100 exhaust pipe 120 allows the gases to escape muffler 100. Two intermediate pipes 122 extend within muffler 100 and channel the gases between the transition chamber and the diffusion chamber. Intermediate pipes 122 are in fluid communication within transition chamber 114 and diffusion chamber 116. These pipes extend through main chamber 112, but are not open thereto.

An intermediate wall 124 is provided between intermediate pipes 122 at the portion thereof that is not adjacent exhaust pipe 120. Intermediate wall 124 prevents early back flow through transitional aperture 138 as explained below. Exhaust pipe 120 extends from diffusion chamber 116 through main chamber 112. A bend 126 allows exhaust pipe 120 to extend back through second inner wall 110, through diffusion chamber 116 to exit through second end wall 106 at an external portion 128. Exhaust pipe 120 is preferably stamped in halves and fitted together. Stamping the halves allows the straightforward manufacture of a pipe with a bend having a larger cross section so as to not restrict air flow. Alternate embodiments include a simple bent pipe to form pipe 120.

A spark arrester 130 is secured to the end of exhaust pipe 120 that is in fluid communication with diffusion chamber 116. An arrester aperture 132 is formed in second end wall 106 to allow spark arrester 130 to be removed and replaced within muffler 100.

An inner shell 134 is provided within main chamber 112, spaced from outer shell 102. An absorption layer 136 is positioned between inner and outer shells 134 and 102. Inner shell 134 includes perforations therein for effective noise attenuation with absorption layer 136.

Note also that transitional aperture 138 is formed within first inner wall 108 to allow the flow of gases from main chamber 112 to transition chamber 114. Transition aperture 138 is preferably at least as large as the diameter of inlet pipe 118.

The basic flow of gases through muffler 100 will now be described. Exhaust gases from the engine enter inlet pipe 118. Inlet pipe 118 directs the gases past transition chamber 114 into main chamber 112. The volume of main chamber 112 is large enough to effectively create an expansion chamber for the gases. This is where the main noise attenuation occurs. Thus, this is the place where inner shell 134 and absorption layer 136 are positioned for noise attenuation. The gases travel throughout main chamber 112, aided by intermediate wall 124. The gases then must pass around the outer walls of exhaust pipe 120 and intermediate pipes 122 before they pass through transition aperture 138 to enter transition chamber 114. Transition chamber 114 is relatively open and provides for little restriction to the flow of exhaust gases to then enter into intermediate pipes 122. Intermediate pipes 122 flow through the body of main chamber 112 without being open thereto. Intermediate pipes 122 channel the exhaust gases from transition chamber 114 at one end of muffler 100 to diffusion chamber 116 at the other end. The exhaust gases then flow through spark arrester 130 and into exhaust pipe 120. Exhaust pipe 120 then extends through the middle of main chamber 112 bending therein to exit back through diffusion chamber 116 and out second end wall 106. The exhaust gases then exit external portion 128.

The flow system described creates very little back pressure while creating superior noise attenuation. Noise attenuation is accomplished by routing the pipes through the main chamber where the gas first enters muffler 100 through inlet pipe 118. The long pipes extending therethrough tend to attenuate the noise while not appreciably increasing back pressure. The system is also easy to manufacture from pipes and stamped metal channels. Furthermore, the muffler system created is lightweight. The system is also tunable for different engines by simply changing the spark arrester as described below in connection with FIGS. 5 and 6.

Figure 6:
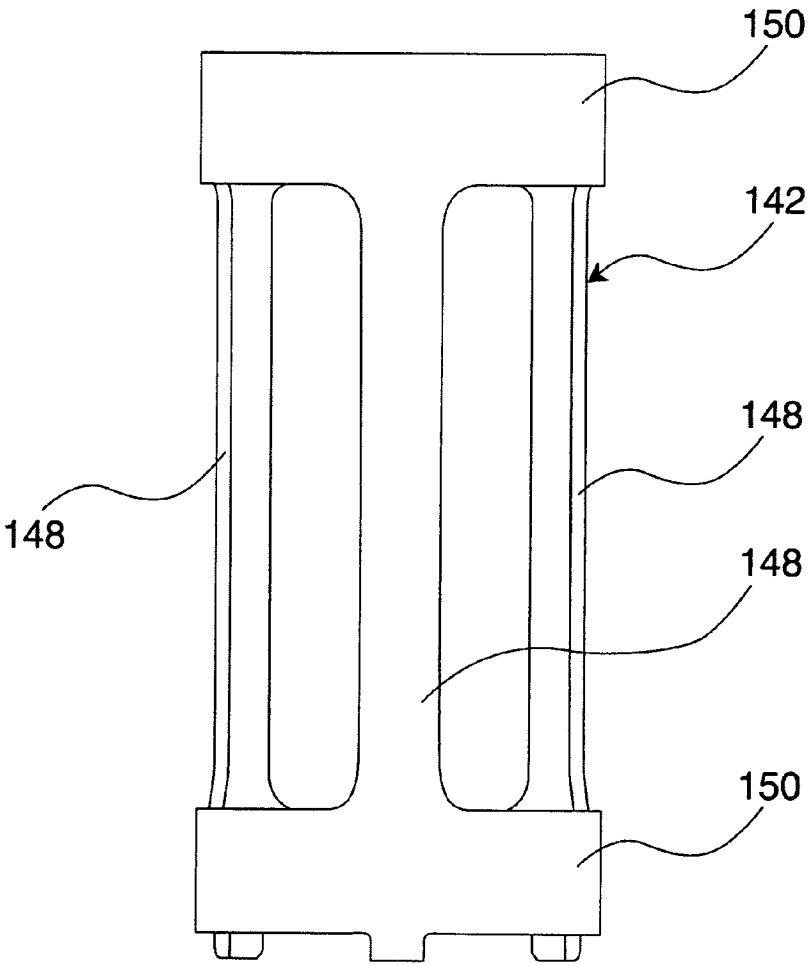
FIG. 6 is a side elevational view of the cage portion of the spark arrester.
Figure 5:
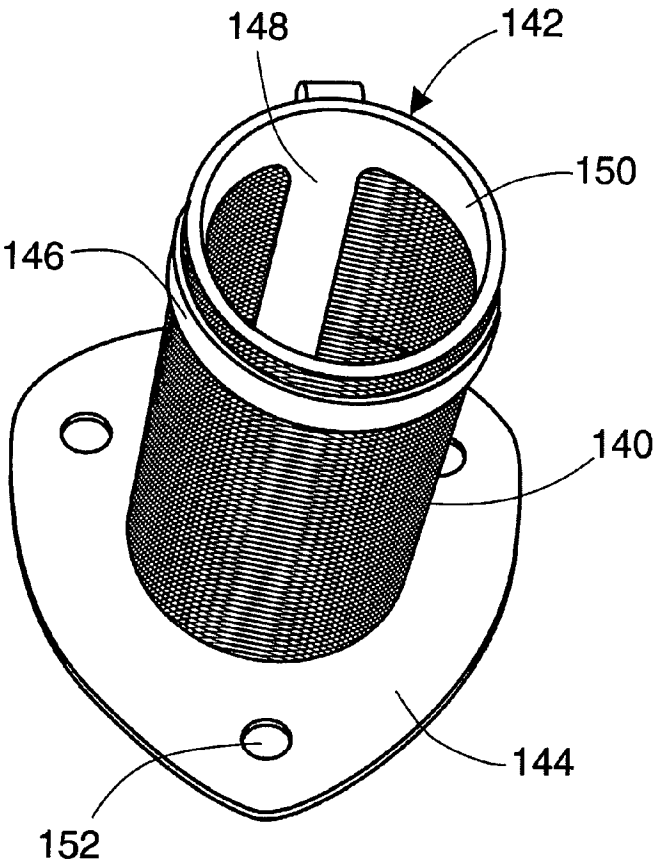
FIG. 5 is an isometric view of the spark arrester element.

FIGS. 5 and 6 illustrate the details of spark arrester 130. Spark arrester 130 includes a screen 140 wrapped around a cage 142. Cage 142 is fixed to an endplate 144 that engages with second end wall 106 with fasteners 153 through holes 152. A band 146 helps secure screen 140 to cage 142.

Cage 142 is constructed with struts 148 and end rings 150. The size of struts 148 are widened or narrowed in order to tune the back pressure of muffler 100 for optimum engine performance in a specific engine application. This is the only piece that need be changed in order to tune the muffler for a specific engine. Thus, muffler 100 can be used for an entire family of ATVs by simple changes to spark arrester 130. This helps decrease the manufacturing costs as more units are produced that are the same. Thus, a specific spark arrester cage 142 may be different from one engine to the next, but the balance of muffler 100 is the same from one to another.

End ring 150 at the inner end of cage 142 is sized to fit over the outer diameter of the entrance to exhaust pipe 120. The openings in screen 140 are such as to provide proper spark arrester function. The ability to remove spark arrester 130 also allows debris and soot material to be expelled from diffusing chamber 116 as may be required. Suitable fasteners 153 through holes 152 may be used to secure endplate 144 to second end wall 106, which may include fastener receptacles therein.

Figure 7:
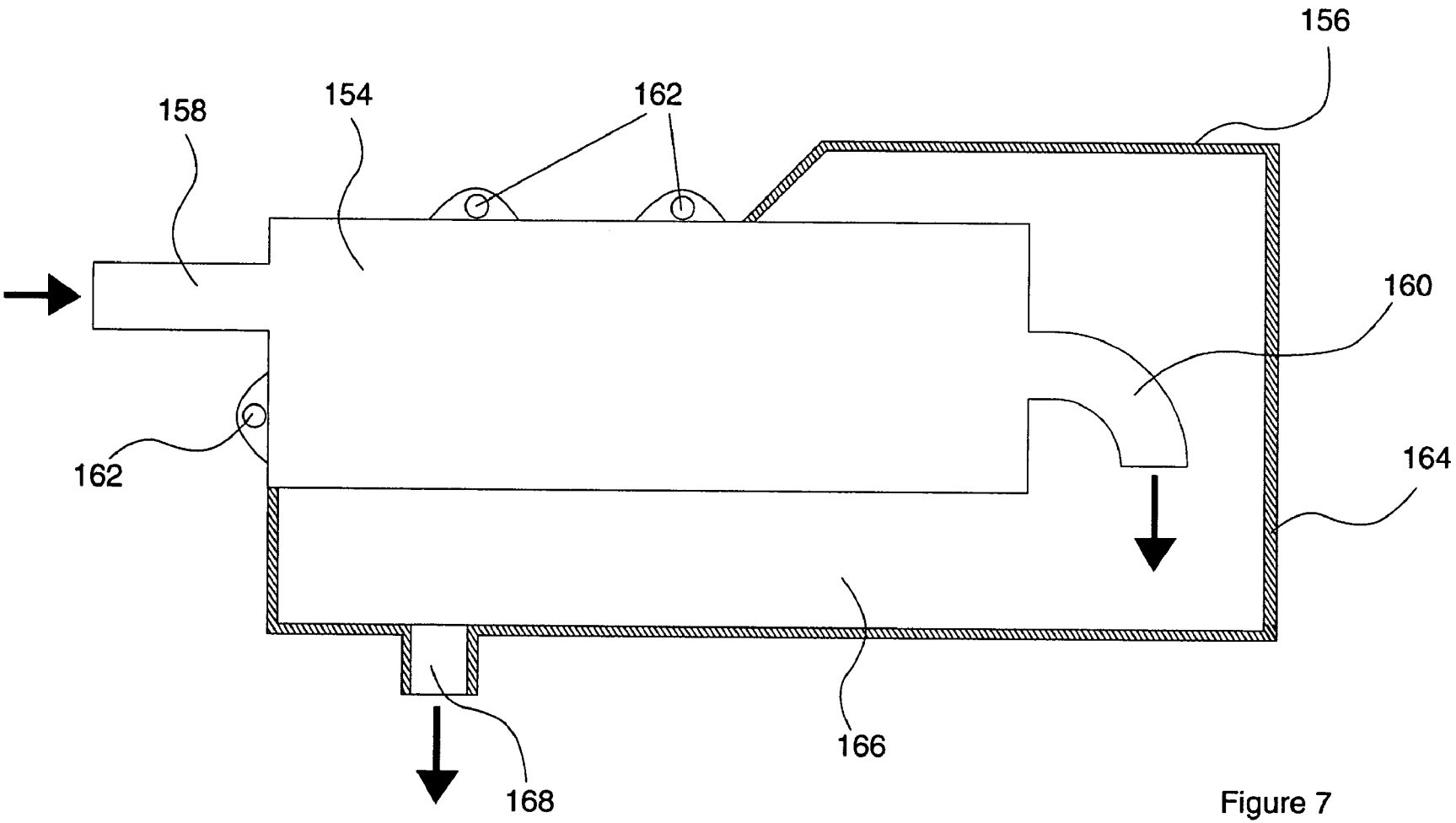
FIG. 7 is a schematic view of the muffler including the outer enclosure.

Turning now to FIG. 7, an additional aspect of the present invention will be described. FIG. 7 illustrates a muffler 154 that includes an outer enclosure 156 surrounding a majority thereof. Muffler 154 may be a standard muffler such as that illustrated in FIGS. 1 and 2 or may be a muffler as described in connection with FIGS. 3 and 4.

Muffler 154 includes an inlet pipe 158, a main body, and an outlet pipe 160. Mounting brackets 162 are preferably secured to the top and side thereof for securement to a vehicle such as an ATV.

Enclosure 156 includes enclosure walls 164 that create an outer chamber 166. Outer chamber 166 encloses a majority of muffler 154 and creates a place where exhaust gases are dumped from outlet pipe 160 before exiting into the environment. Outer chamber 166 is of a size sufficiently large such that expansion of gases is easily accomplished and additional back pressure is minimal. An enclosure exit 168 is provided. Enclosure exit 168 may be situated anywhere on enclosure walls 164. Preferably, it is not in the direct line of exhaust exit from outlet pipe 160. Thus, exhaust gases enter muffler 154 then exit through outlet pipe 160 to enter outer chamber 166 where the gases are further cooled and quieted before exiting enclosure exit 168. This arrangement provides additional noise attenuation as well as a cooler interface between the user and the hot exhaust gases. Enclosure 156 also reduces heat at the user and machine parts interface to the extent that it preferably completely replaces any remote heat shields that are customarily attached to the outer wall of muffler 156 or to other parts of the machine to deflect heat from the muffler. External heat shields are often used to protect parts of the machine or vehicle that may overheat or even melt, such as the carburetor and plastic parts. The heat shielding effect of enclosure 156 reduces or eliminates the need for such additional shields. Noise reduction is accomplished through a reduction in exiting exhaust gas noise as well as attenuation of muffler shell noise.

Figure 8:
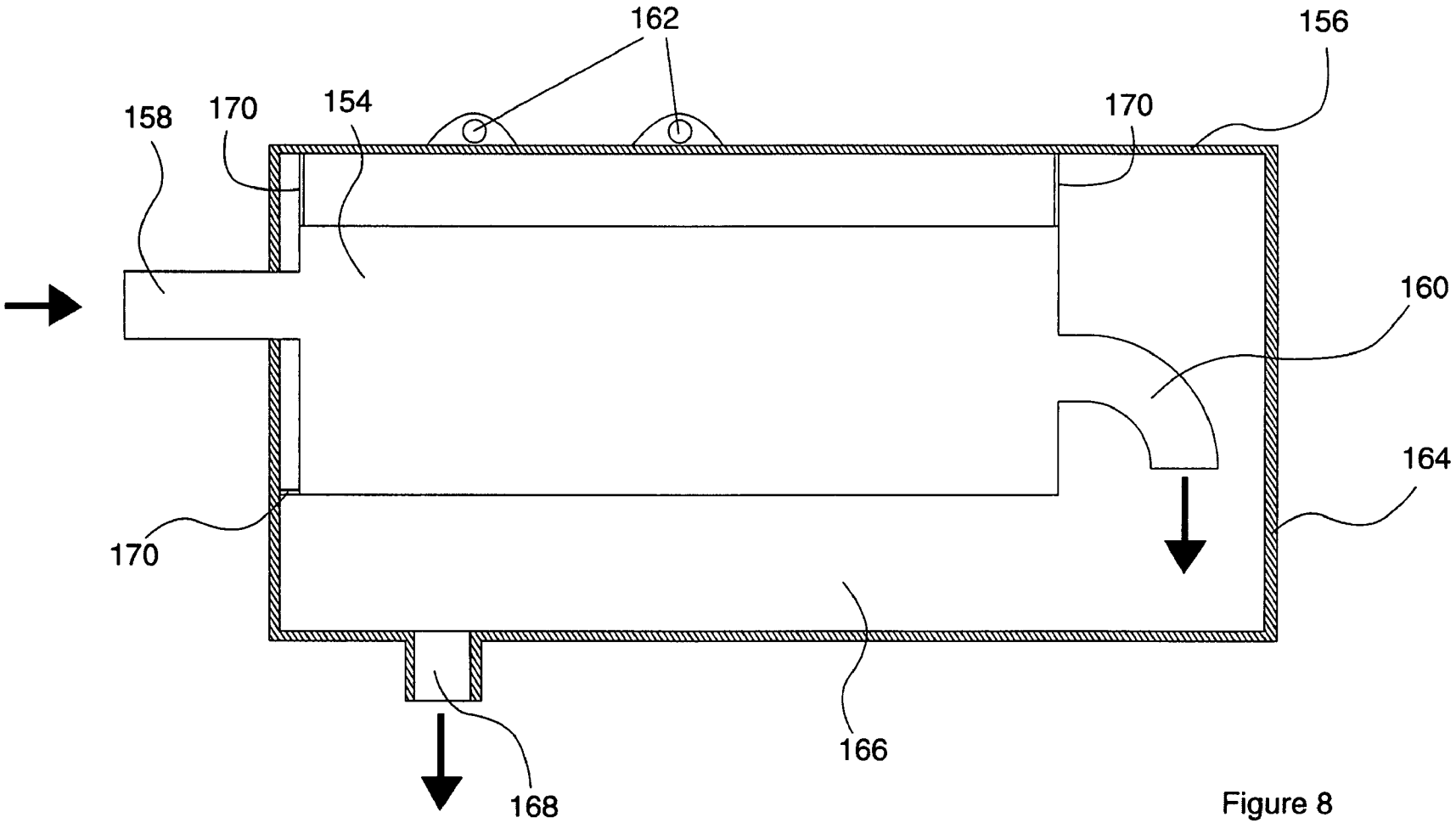
FIG. 8 is a schematic view of a muffler with a complete enclosure.

Enclosure walls 164 may completely encompass muffler 154, as illustrated in FIG. 8, or may partially encompass the muffler as illustrated in FIG. 7. In the case of complete enclosure, struts 170 between muffler 154 and enclosure walls 164 preferably hold the spaced relationship between the two members with mounting brackets 162 secured on enclosure walls 164. Other arrangements are also possible that accomplish the purposes of having an outer chamber into which the exhaust gases are dumped before exiting the muffler system.

Figure 9:
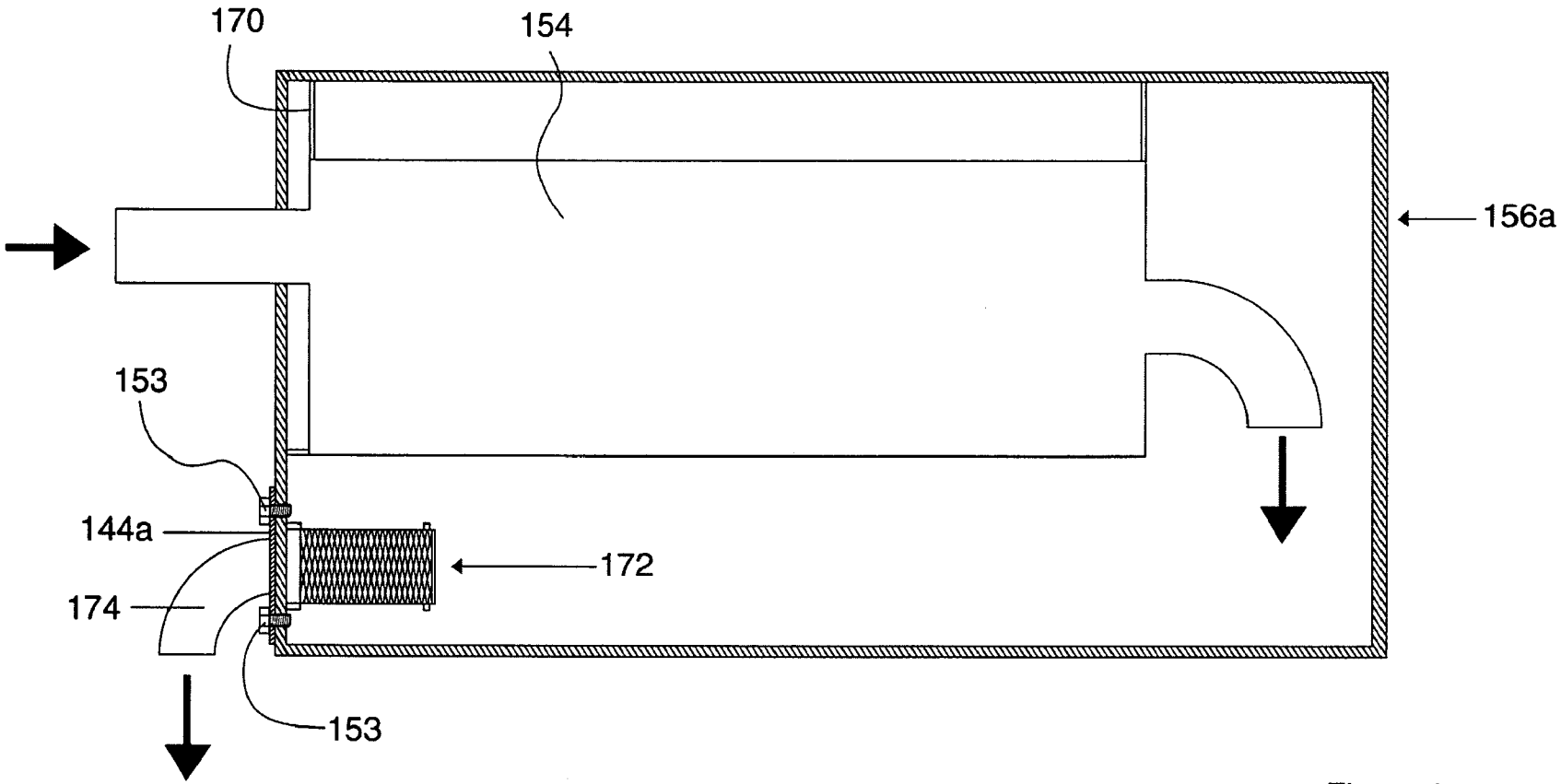
FIG. 9 illustrates the enclosure of FIG. 8 with the addition of a removable spark arrester.

Turning now to FIG. 9, an embodiment of a completely enclosed muffler is illustrated. However, in this embodiment, a spark arrester is held within the enclosure body. A separate spark arrester may or may not be included within the main muffler 154. Enclosure 156*a* includes an opening into which fasteners 153 secure spark arrester assembly 172. Spark arrester assembly 172 is similar to spark arrester 130 except that assembly 172 also includes an exit pipe 174 secured directly to the outer end thereof. Spark arrester assembly 172 includes an endplate 144*a* with an aperture there through to which exit pipe 174 is secured, preferably by a weld.

Figure 10:
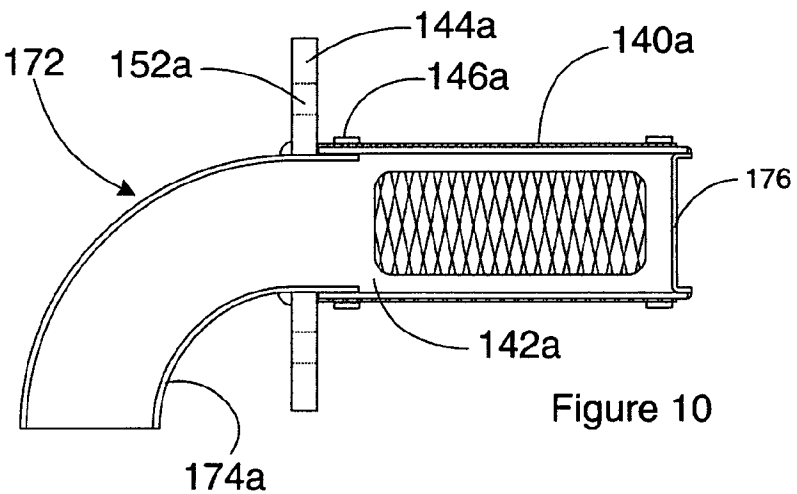
FIG. 10 illustrates the details of the spark arrester illustrated in FIG. 9.
Figure 11:
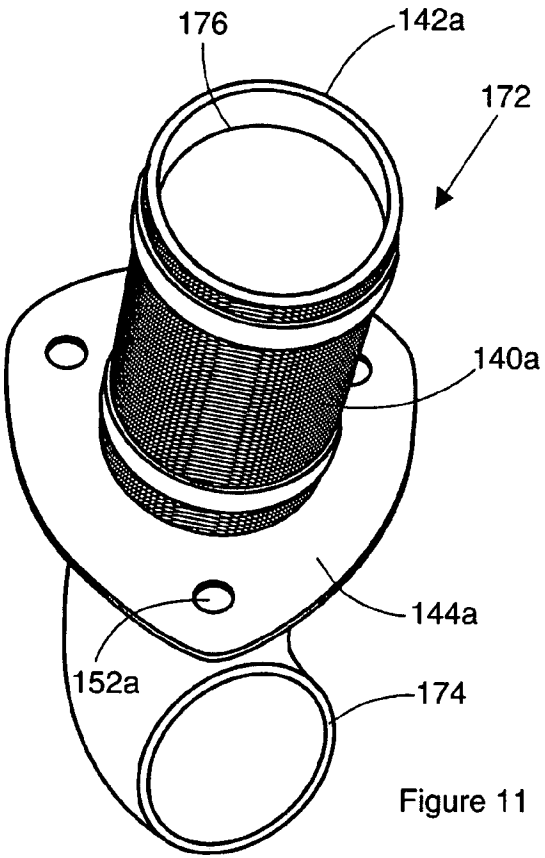
FIG. 11 is an isometric view of the spark arrester.

The details of construction of spark arrester assembly 172 are illustrated in FIGS. 10 and 11. Spark arrester assembly 172 is constructed with a cage 142*a* having an inner cap 176. Cap 176 may alternatively be at least partially replaced with screen material similar to screen 140*a* that surrounds cage 142*a*. Clamps 146*a* secure screen 140*a* to cage 142*a*. Fasteners are secured through holes 152*a* and mounting plate 144*a*.

Exhaust gases within enclosure 156*a* go through screen 140*a*, through endplate 144*a* and exit pipe 174.

Figure 12:
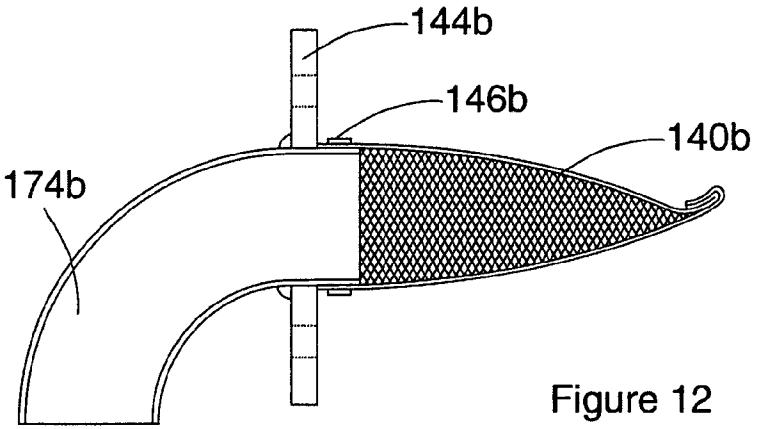
FIG. 12 is a side elevational view of an alternate spark arrester with a tapered screen.

An alternate embodiment of a spark arrester assembly is also illustrated in FIG. 12. In this embodiment, the cage is eliminated. A screen tube is provided having an inner, closed end compressed together by rolling the screen material. Other fixation means to close the end may alternatively be employed. The outer end includes a clamp 146*b* that secures screen 140*b* to exit pipe 174*b*. Exit pipe 174*b* is welded to mounting plate 144*b*, but extends through such that the outer end of screen 140*b* can be clamped thereto.

Figure 13:
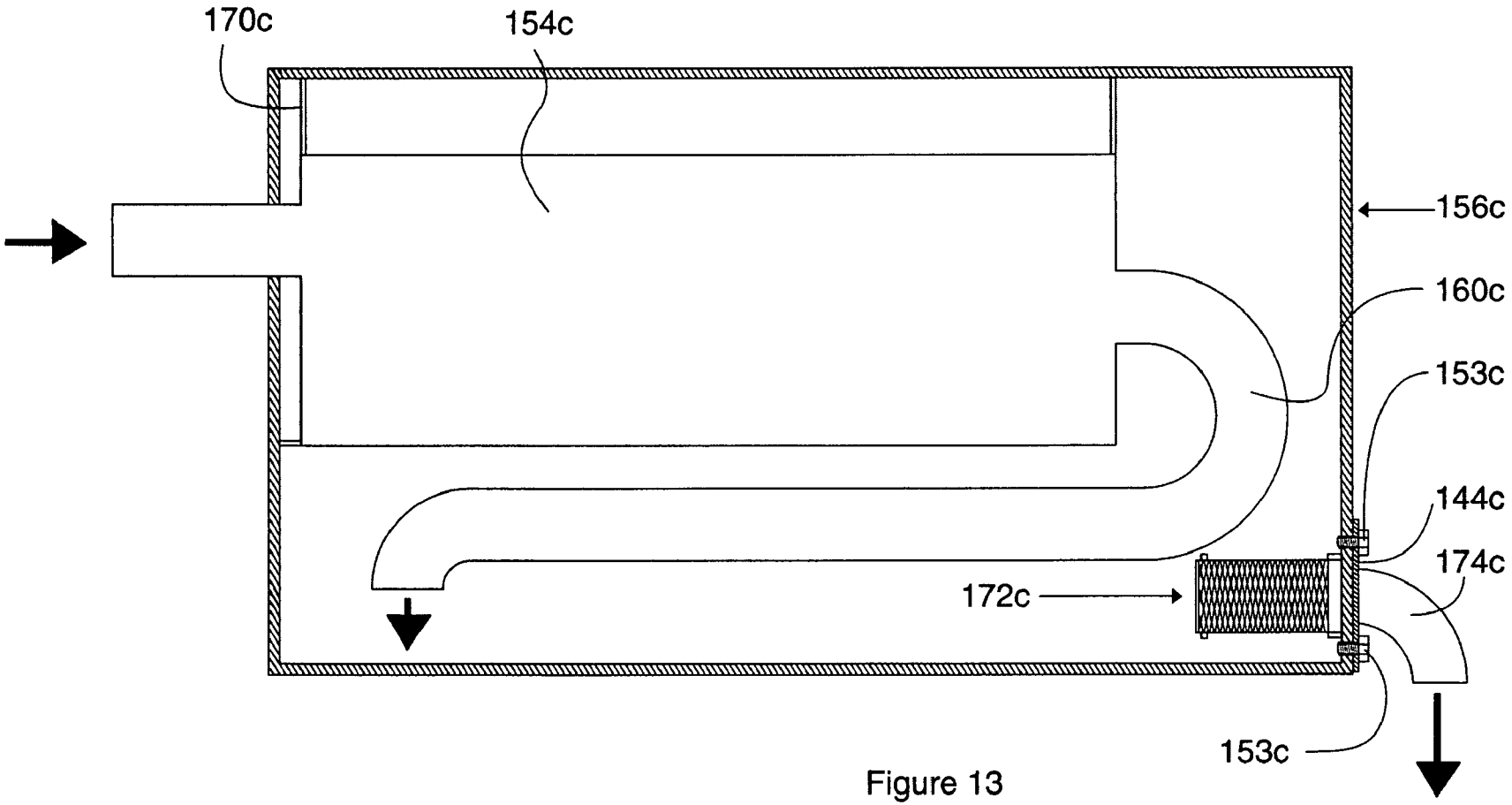
FIG. 13 is a schematic view of an enclosed muffler and pipe.

FIG. 13 illustrates an alternate embodiment similar to FIG. 9 with an elongated tail pipe 160*c* within outer enclosure 156*c*. Tail pipe 160*c* extends from one end of muffler 154*c* some distance within outer enclosure 156*c*, preferably to the other end of outer enclosure 156*c*. A bend is preferably formed in pipe 160*c* such that a long length of pipe fits within outer enclosure 156*c*. Spark arrester assembly 172*c* is situated out of direct alignment with the exhaust gas exit from pipe 160*c*. Thus in this embodiment it is on the opposite side of outer enclosure 156*c*. This long-pipe arrangement within enclosure 156*c* further quiets the exhaust noise of the entire muffler assembly with little additional backpressure. The additional silencing achieved with enclosure 156*c* may allow more design flexibility for muffler 154*c*. Thus, a simpler, less expensive design may be employed. Muffler 154*c* in one embodiment includes an internal elongated pipe, while another embodiment omits such pipe.

Figure 14A:
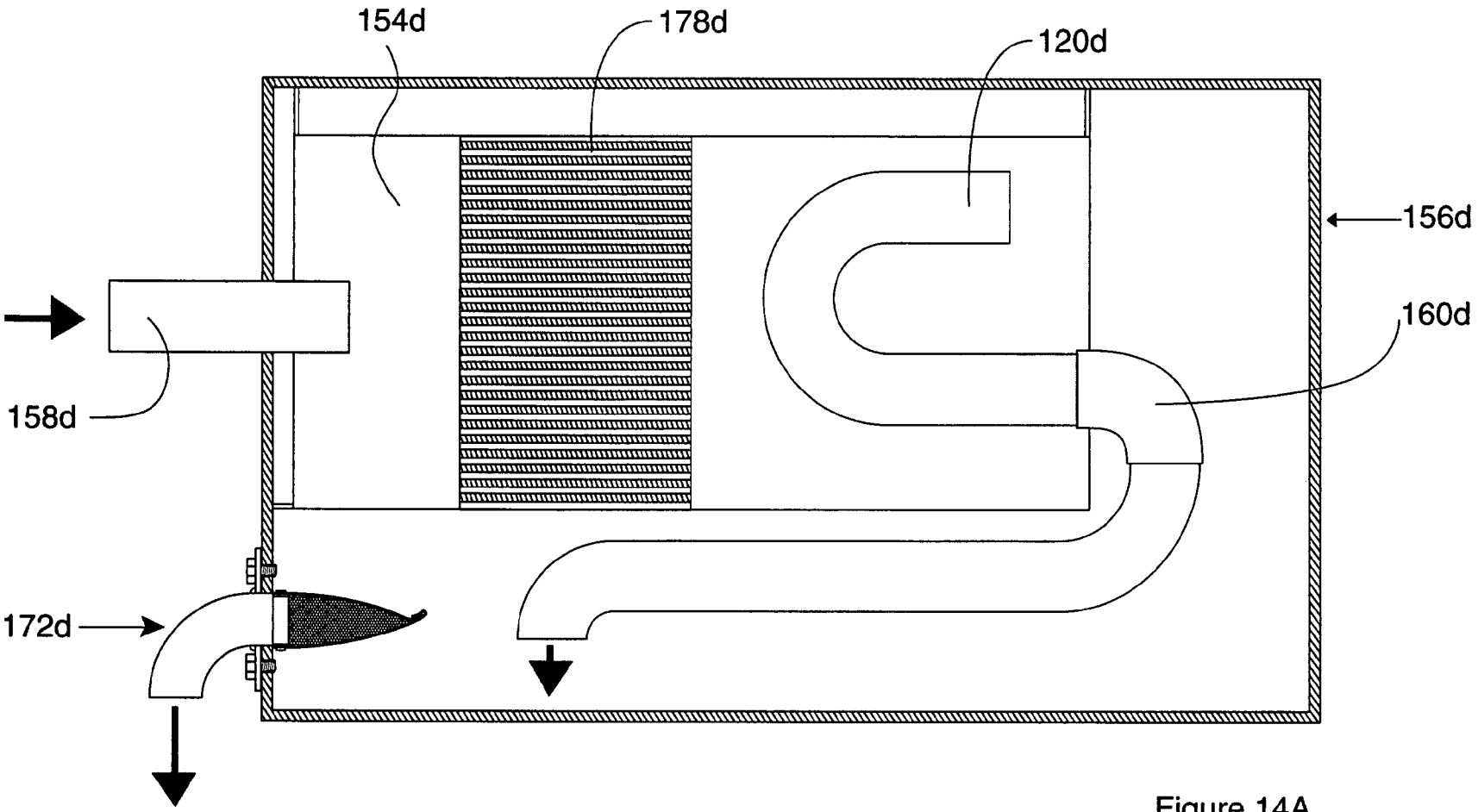
FIG. 14A is a schematic view of an enclosed muffler having a catalytic converter.
Figure 14B:
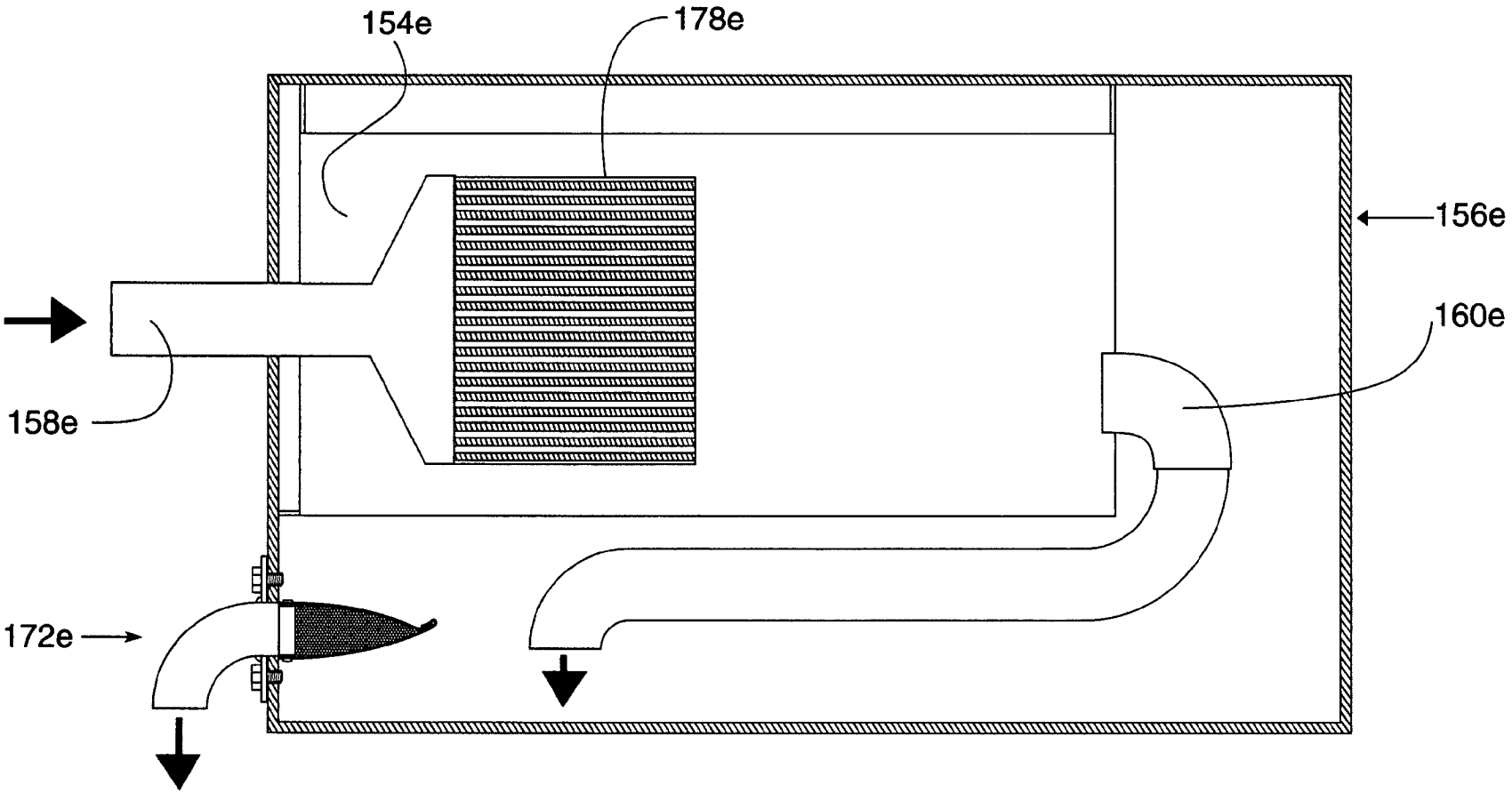
FIG. 14B is a schematic view a variation of the muffler of FIG. 14A.
Figure 14C:
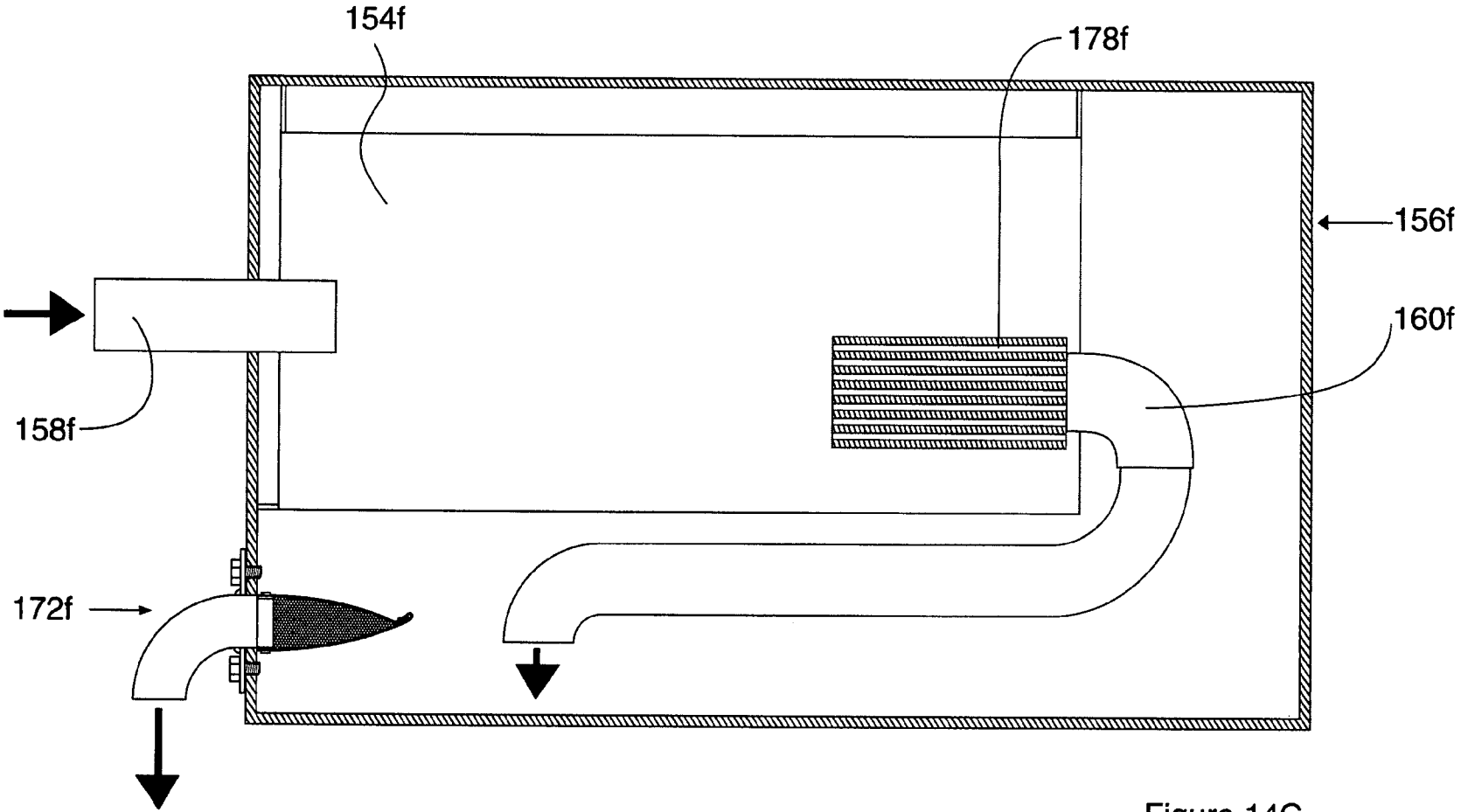
FIG. 14C is a schematic view a further variation of the muffler of FIG. 14A.

FIGS. 14A-C illustrate a muffler design variation including a catalytic converter 178. Thus, in FIG. 14A catalyst 178*d* is positioned within muffler 154*d* between inlet pipe 158*d* and exhaust pipe 120*d*. As exhaust gases run through catalyst 178*d*, not only are pollutants (such as carbon monoxide and nitrous oxides) reduced, but noise is also diminished. In this embodiment, exhaust pipe 120*d* forms a 180 degree bend within muffler main 154*d*. Exhaust pipe 120*d* joins with outlet pipe 160*d*, which runs within enclosure 156*d* outside of muffler 154*d*. Outlet pipe 160*d* preferably forms a 180 degree bend within enclosure 156*d* before dumping exhaust gases into enclosure 156*d* for exit through spark arrester assembly 172*d*.

In a variation of the arrangement described above (FIG. 14B), a catalyst 178*e* is secured directly to an inlet pipe 158*e*. Exhaust gases run through catalyst 178*e* as they enter muffler 154*e*. The gases run through muffler 154*e*, after which they exit through outlet pipe 160*e* and spark arrester assembly 172*e*. In the preferred embodiment, outlet pipe 160*e* includes a 180 degree bend and an elongated pipe similar to that discussed above in connection with FIG. 13.

In a further variation (FIG. 14C), a catalyst 178*f* is secured to outlet pipe 160*f*. In this embodiment, exhaust gases pass through catalyst 178*f* as they exit muffler 154*f*. Again in this preferred embodiment, outlet pipe 160*f* includes a 180 degree bend and an elongated pipe.

The placement of catalyst 178 in any of the embodiments discussed herein may be made depending on the particular engine and its tuning requirements. In each embodiment herein catalyst 178 acts as an additional silencer in addition to its pollution control capabilities.

While the preferred embodiments of the invention have been illustrated and described, as noted above, many changes can be made without departing from the spirit and scope of the invention. For example, alternate shapes and pipes may be used. Different numbers and arrangements of pipes may also be employed. Accordingly, the scope of the invention is not limited by the disclosure of the preferred embodiment. Instead, the invention should be determined by reference to the claims that follow.

The embodiments of the invention in which an exclusive property or privilege is claimed are defined as follows:

1. A muffler for receiving exhaust gas from an internal combustion engine, the muffler comprising:

an outer shell having a length defined by a first end wall and a second end wall;

a first chamber located in the outer shell;

a main chamber located in the outer shell and adjacent the first chamber into which exhaust gases are channeled, the main chamber having an exit, a first region and a second region both in fluid communication with one another;

an exhaust pipe in fluid communication with said main chamber exit, said exhaust pipe extending within said main chamber and having at least one bend within said chamber, said exhaust pipe exiting said main chamber; and an intermediate wall positioned in the main chamber to channel the exhaust gases past the first region of the main chamber and toward the second region of the main chamber;

an intermediate pipe in fluid communication with the second region of the main chamber and arranged to receive the exhaust gases from the main chamber, the intermediate pipe extending through the main chamber.

2. The muffler of claim 1, wherein the muffler encloses a volume of gas and wherein said chamber encloses at least a third of the volume of said muffler.

3. The muffler of claim 1, wherein said bend substantially completes a 180 degree turn within said chamber.

4. The muffler of claim 1, further comprising a diffuser between said chamber and said exhaust pipe, said diffuser directing flow of gases at least partially between said chamber and said exhaust pipe.

5. The muffler of claim 4, further comprising a spark arrester disposed within said diffuser and connected to said exhaust pipe, gases passing through said spark arrester before entering said exhaust pipe.

6. The muffler of claim 1, wherein said chamber has a length, said exhaust pipe being longer than said chamber.

7. The muffler of claim 6, wherein said bend substantially completes a 180 degree turn within said chamber, the length of said exhaust pipe within said chamber being longer than said chamber.

8. A method of attenuating exhaust noise of an internal combustion engine comprising:

channeling exhaust gases from the engine into an entry port extending through an exhaust gas inlet side of a muffler, the entry port in fluid communication with a main chamber of the muffler;

channeling the exhaust gases through the entry port and into the main chamber;

directing the exhaust gases around an intermediate wall positioned within the main chamber, the intermediate wall extending longitudinally within the main chamber and arranged to at least partially segregate the main chamber into a first region and a second region, wherein directing the exhaust gases around the intermediate wall includes reversing a direction of the exhaust gases within the main chamber such that the exhaust gases flow through the first region and then reverse direction to flow around the intermediate wall, into the second region, and back toward the entry port of the muffler;

channeling the gases from the main chamber into an exhaust pipe that extends through the main chamber, said exhaust pipe being longer than the length of the main chamber; and reversing a direction of gases though the exhaust pipe by directing the exhaust gases around a bend formed by the exhaust pipe; and channeling the gases from the exhaust pipe to an exhaust exit.

9. The method of claim 8, further comprising channeling the gases through an intermediate pipe between said main chamber and said exhaust pipe.

10. The method of claim 9, further comprising channeling the gases through a diffusion chamber between said intermediate pipe and said exhaust pipe.

11. The method of claim 10, wherein said exhaust pipe includes a bend as it extends within said main chamber.

12. The method of claim 8, further comprising channeling the gases through a spark arrester disposed between said main chamber and said exhaust pipe.

* * * * *